US006667675B2

(12) United States Patent
Gibson et al.

(10) Patent No.: US 6,667,675 B2
(45) Date of Patent: Dec. 23, 2003

(54) ADJUSTABLE MAGNETIC TRIP ASSEMBLY FOR CIRCUIT BREAKER

(75) Inventors: Jeffrey Scott Gibson, Hookstown, PA (US); Craig Allen Rodgers, Butler, PA (US); Erik Stephen Lake, Groton, CT (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/136,179

(22) Filed: May 1, 2002

(65) Prior Publication Data

US 2003/0206086 A1 Nov. 6, 2003

(51) Int. Cl.[7] ..... H01H 71/74; H01H 75/10

(52) U.S. Cl. ..... 335/172; 335/42; 335/171; 335/176; 335/274

(58) Field of Search ..... 335/6, 21, 38, 335/42, 167, 170, 171, 172, 174, 175, 176, 270, 274

(56) References Cited

U.S. PATENT DOCUMENTS 3,758,887 A 9/1973 Ellsworth et al.
3,815,064 A 6/1974 Maier et al.
4,697,163 A 9/1987 Grunert et al.
4,973,928 A 11/1990 Grunert
5,831,501 A 11/1998 Kolberg et al.

*Primary Examiner*—Ramon M. Barrera
(74) *Attorney, Agent, or Firm*—John A. Kastelic; Martin J. Moran

(57) ABSTRACT

An adjustable magnetic trip unit for a circuit breaker includes a torsion spring which applies a bias force to the plunger of a trip solenoid. The torsion spring is mounted on a driven bevel gear and wound by an adjustment knob coupled to a driving bevel gear to adjust the current at which the solenoid is activated. An indexer having peripheral flats which engage a seat in the circuit breaker housing provides a plurality of discrete positions of the adjustment knob. Depressing the adjustment knob against a second spring unseats the indexer for rotation of the adjustment knob between settings. In addition, a slide with an inclined surface bearing against the plunger and coupled to the driven bevel gear, provides simultaneous adjustment of plunger gap with adjustment of the torsion spring force to increase the range of adjustment.

20 Claims, 3 Drawing Sheets

ADJUSTABLE MAGNETIC TRIP ASSEMBLY FOR CIRCUIT BREAKER

BACKGROUND OF THE INVENTION

1. Field of the Invention

This invention relates to a trip assembly for a circuit breaker which responds to the magnetic forces generated by overcurrents. More particularly, it relates to an arrangement for the user of the circuit breaker to easily adjust the level of overcurrent at which the magnetic trip assembly responds.

2. Background Information

A common type of circuit breaker trip unit which responds with an instantaneous trip to overcurrents such as those caused by a short circuit utilizes a magnetic solenoid. The current in the protected circuit is conducted through the coil windings generating attraction forces between a stationary and a movable armature. A spring generates a bias force opposing the attraction force applied to the movable armature. When the current magnitude achieves a level at which the magnetic force exceeds the spring biasing force, the moving armature pulls into the stationary armature. This mechanical motion is used to trip the circuit breaker. Commonly, this occurs at a discreet value of current.

It is an object of the present invention to provide an arrangement for easy adjustment of the magnetic tripping current in the field.

SUMMARY OF THE INVENTION

In accordance with the invention, an adjustable magnetic trip unit for a circuit breaker comprises a trip solenoid having a coil and a plunger movable relative to the coil. A first end of the plunger is extendable from a first end of the coil to a trip position when the coil is energized by a current of at least of a selected amplitude. The second end of the plunger extends from the second end of the coil. A spring assembly includes a spring engaging the second end of the plunger to apply a bias force to the plunger setting the selected amplitude of current, and an adjustment mechanism adjusting the bias force, and therefore, the selected amplitude of the current. The spring can be a torsion spring having a first end engaging the second end of the plunger and a second end wound by the adjustment mechanism to adjust the bias force. This adjustment mechanism includes an indexer setting discrete positions to which the second end of the torsion spring is wound to provide a plurality of discrete values of the selected amplitude of current. The adjustment mechanism also includes an adjustment knob for setting the indexer to the plurality of discrete positions and a coupler coupling the adjustment knob to the second end of the torsion spring. The coupler comprises a first bevel gear engaging the second end of the torsion spring, a second bevel gear engaging the first bevel gear, and a shaft connecting the second bevel gear to the adjustment knob for rotation by the adjustment knob. The torsion spring has an axis coincident with the pivot axis of the first bevel gear which is substantially perpendicular to the plunger. The shaft has an axis which is orthogonal to both the plunger and the axis of the torsion spring.

The adjustable magnetic trip unit is adapted to be mounted in a circuit breaker housing having a seat. The indexer is mounted on the shaft and has a peripheral cam surface engagable with the seat in the plurality of discrete rotational positions. The indexer is axially displaceable between a locked position engaging the seat and an unlocked position free of the seat in which the indexer, and therefore the shaft, can be rotated between the plurality of discrete positions. A second spring biases the indexer to the locked position. The indexer is movable against the biasing provided by the second spring by depression of the adjustment knob. The adjustment mechanism can include a gap adjuster engaging the second end of the plunger and driven by the first bevel gear to adjust the position to which the plunger is biased by the torsion spring.

In addition, the invention is directed to a circuit breaker adjustable magnetic trip assembly which includes a housing, a trip solenoid having a coil energized by load current and a plunger movable to a trip position in response to load current above a selected amplitude, a torsion spring having a first end engaging the plunger to apply a bias force to the plunger setting the selected amplitude of the load current at which the plunger moves to the trip position and an adjustment mechanism. The adjustment mechanism comprises a first bevel gear engaging a second end of the torsion spring, a second bevel gear engaging the first bevel gear, a shaft engaging the second bevel gear, an adjustment knob mounted on the shaft, and an indexer setting a plurality of discrete rotational positions of the adjustment knob. The housing has a seat and the indexer selectively engages the seat at the plurality of discrete rotational positions. The indexer has a peripheral cam surface with a plurality of flats and a seat in the housing has complimentary flat surfaces against which the indexer seats at the plurality of discrete rotational positions. The indexer is mounted for axial movement between a locked position in which it engages the seat and an unlocked position in which it and the adjustment knob are free to rotate. The adjustment mechanism further includes a bias spring biasing the indexer axially to the locked position. The housing can be a molded housing having a first slot forming the seat and an axially adjacent second slot with which the indexer is aligned in the unlocked position. The second slot is sized to allow rotation of the indexer. The housing has a third slot adjacent the second slot in which the second bevel gear is mounted for rotation. The adjustment knob and the indexer are axially movable relative to the second bevel gear which is restrained from axial movement by the third slot.

The adjustment mechanism further includes a gap adjuster adjusting an unactuated position to which the plunger is biased by the torsion spring. This gap adjuster can comprise an adjustment member coupled to and moved by the first bevel gear. The plunger can have a first inclined surface and the adjustment member can be a slide having gear teeth engaging the first bevel gear and a complimentary second inclined surface engaging the first inclined surface. The plunger can have a first end extendable from the first end of the coil to a trip position and a second end extending from a second end of the coil and having a flange with a first axially facing surface engaged by the first end of the torsion spring and a second axially facing surface bearing against the first inclined surface.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
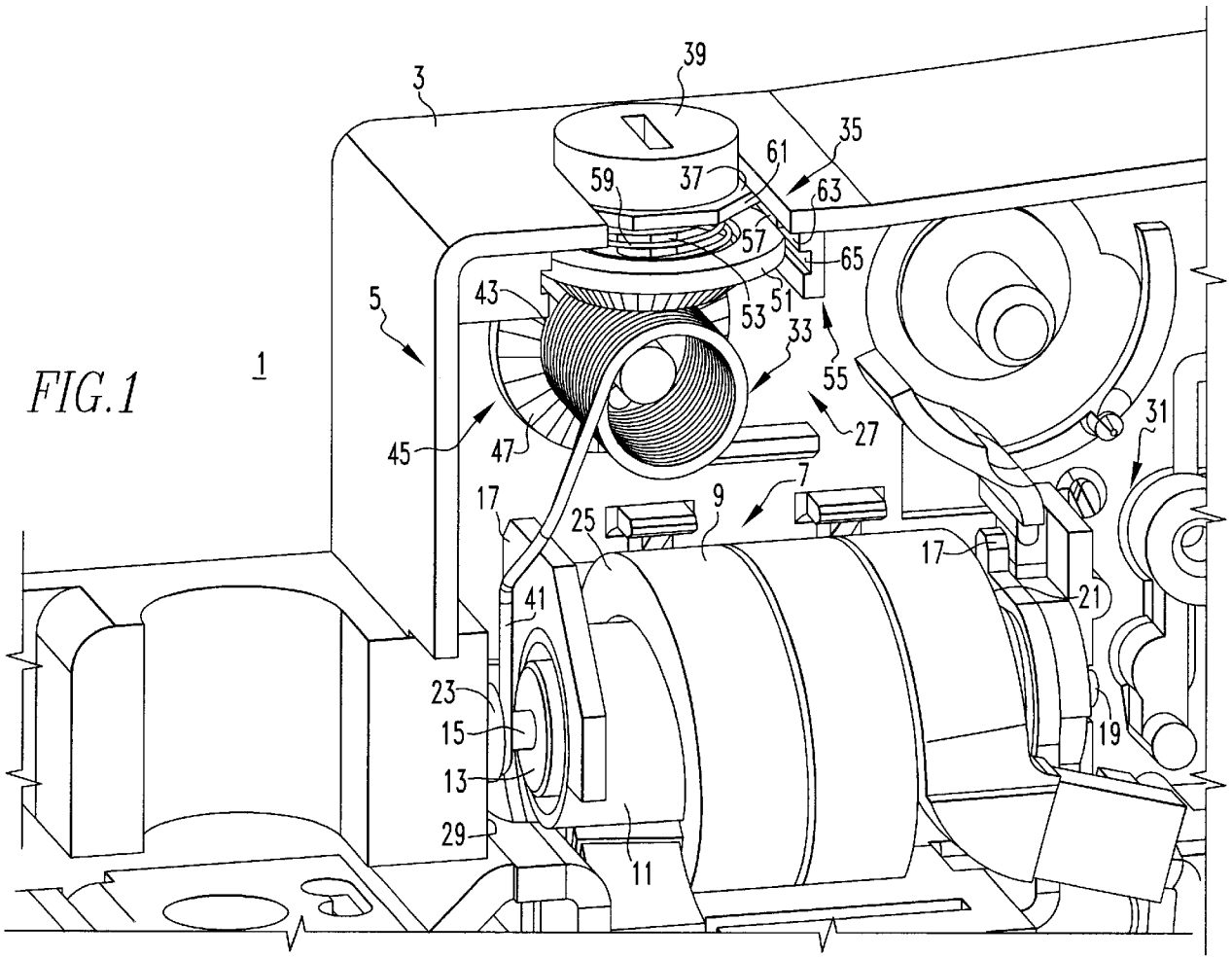
FIG. 1 is a fragmentary isometric view of a circuit breaker with the cover removed illustrating the adjustable magnetic trip unit of the invention.

FIG. 1 illustrates a circuit breaker adjustable magnetic trip assembly 1 which includes a molded circuit breaker housing 3 and an adjustable magnetic trip unit 5. This adjustable magnetic trip unit 5 includes a trip solenoid 7 which has a coil 9 through which current in the protected circuit is routed. The coil 9 is wound on a nonmagnetic sleeve 11 within which a stationary armature 13 is mounted. A plunger is forming a movable armature is axially slideable within the stationary armature 13. The sleeve 11 and therefore the trip solenoid 7 is fixed within the molded housing 3 by integral mounts 17 molded as part of the housing. The plunger 15 has a first end 19 that extends out of a first end 21 of the coil 9 and can be a separate nonmagnetic section. A circular flange 23 forms a second end of the plunger 15 that extends out of a second end 25 of the coil 9.

A spring assembly 27 biases the flange 23 of the second end of the plunger 15 against an abutment surface 29 within the housing 3. Current through the coil 9 generates magnetic forces which tend to draw the plunger 15 to the right as viewed in FIG. 1 so that the first end 19 extends out of the first end of the coil to a trip position in which it engages and trips the trip mechanism indicated generally at 31 in FIG. 1. This only occurs when the magnetic attraction force generated by the current is sufficient to overcome the bias force applied by the spring assembly 27. The spring assembly 27 allows the magnitude of the current at which this occurs to be selected.

The spring assembly 27 includes a spring 33 and an adjustment mechanism 35 for adjusting the spring force. This adjustment mechanism 35 includes an indexer 37 and an adjustment knob 39 which rotates the indexer. The spring 33 is a torsion spring having a first end 41 which bears against the flange 23 to bias the plunger 15 against the abutment surface 29. A second end 43 of the torsion spring 33 is coupled to the adjustment mechanism 35 by a coupler 45 which includes a first or driven bevel gear 47 mounted in the housing 3 for rotation about an axis 49 perpendicular to the plunger 15. The second end 43 of the torsion spring 33 is secured to this driven bevel gear 47 and rotated by it to adjust the bias force applied to the plunger 13. The coupler 45 includes a second or driving bevel gear 51 engaging the first bevel gear 47. A noncircular shaft 53 is axially slidable with respect to the second bevel gear 51 and is keyed to this second bevel gear 51 to rotate it with rotation of the shaft. The shaft 53 carries the indexer 37 and the adjustment knob 39.

Figure 2:
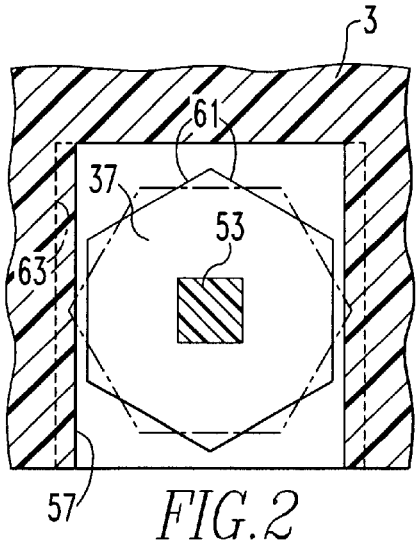
FIG. 2 is a fragmentary cross-sectional view through a portion of the circuit breaker housing shown in FIG. 1.

The circuit breaker housing 3 has a seat 55 in which the adjustment mechanism 35 is seated. This seat 55 defines a first slot 57 in which the indexer 37 is seated by a locking spring 59. The indexer 37 is a disc with a peripheral camming surface 61 which can be formed by a number of flats. As best seen in FIG. 2, the slot 57 is sized so that the indexer can only be seated when it is rotated by the adjustment knob 39 to positions in which the flats 61 are aligned with the walls of the slot 57. When seated in the slot 57, the indexer 37 cannot be rotated. Below the slot 57 is a second slot 63 which is wider and allows the indexer 37 to be rotated between the plurality of discrete positions set by the flats 61. A third slot 65 in the molded housing below the slot 63 mounts the second bevel gear 51 for rotation (see FIG. 1).

The locking spring 59 biases the indexer 37 upward to a locked position within the first slot 57 at one of the plurality of discrete positions. The bias force applied by the torsion spring 33 to the plunger 15 can be adjusted by depressing the adjustment knob 39 thereby moving the indexer axially downward out of the slot 57 into alignment with the second slot 63 in which it can be rotated to another one of the discrete rotational positions in which the flats 61 of the indexer align with the second slot. This rotation of the indexer 37 rotates the second bevel gear 51 which, in turn, rotates the first bevel gear 45 to adjust the bias force applied by the torsion spring 33 to the plunger 13 of the trip solenoid 7. Release of the adjustment knob 39 allows the locking spring 59 to raise the indexer 37 into the locked position within the slot 57 in one of the discrete positions.

With the arrangement shown, the torsion spring 33 can be specified with many windings and a generous outside diameter resulting in a low spring constant. Low spring constants are beneficial in adjustment mechanisms because they are less sensitive to dimensional variation in assembly components.

Figure 3:
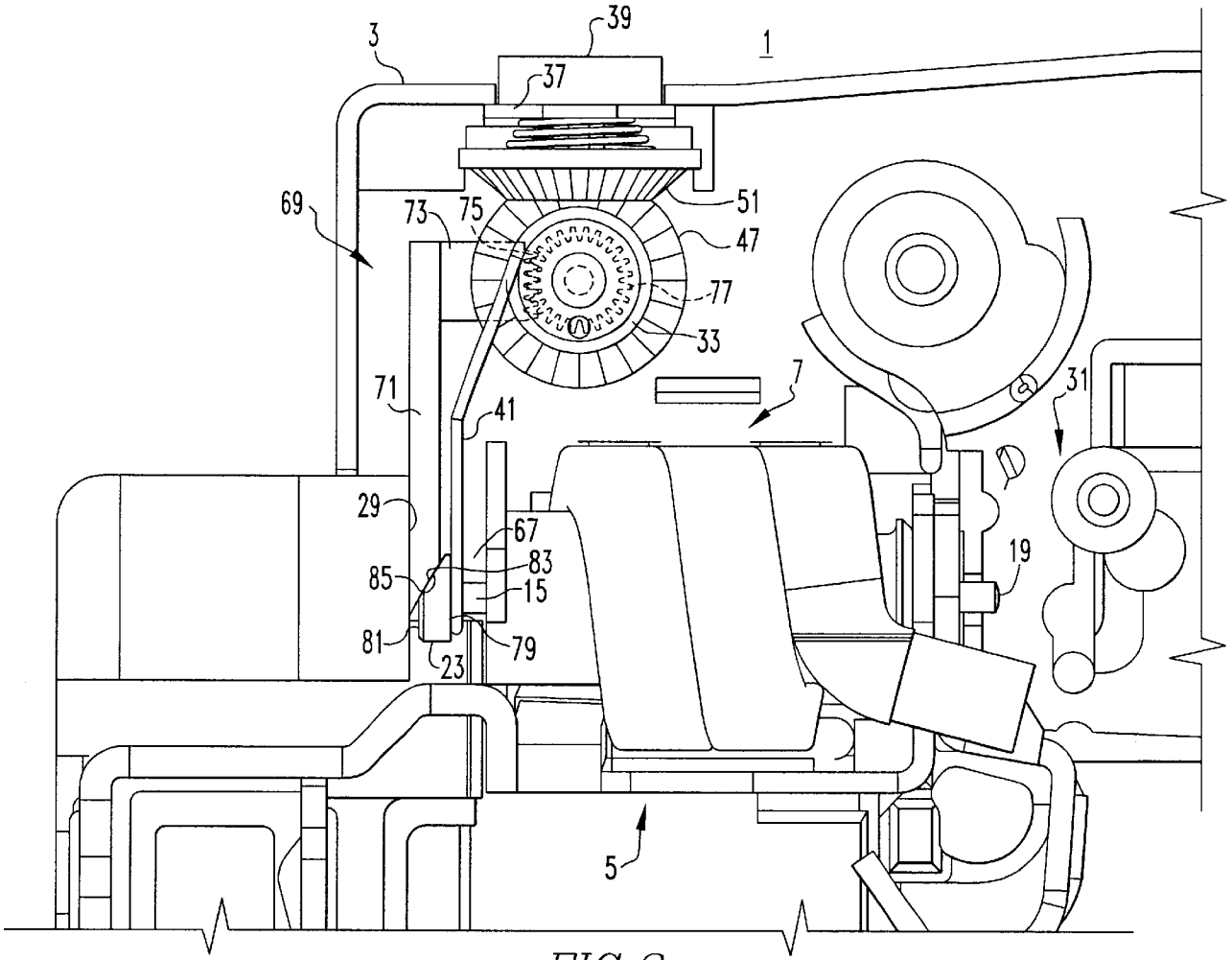
FIG. 3 is a fragmentary elevation view of a circuit breaker housing with the cover removed illustrating a second embodiment of the invention.

In the arrangement described above, the air gap 67 between the flange 23 on the plunger or moving armature 15 and the stationary armature 13 is fixed. In situations where larger adjustment ranges are required than can be provided by adjusting the bias force applied by the torsion spring 33, this air gap 67 can also be varied. Thus, as shown in FIG. 3, the adjustment mechanism 35 can include a gap adjuster 69. The gap adjuster 69 includes an adjustment member in the form of a slide 71 that is coupled to and moved by the first bevel gear 47. This coupling is accomplished by a rack 73 having gear case 75 which mesh with a pinion gear 77 fixed to the first bevel gear 47. In this embodiment, the flange 23 on the end of the plunger 15 has a first axially facing surface 79 against which the first end 41 of the torsion spring 33 bears, and a second axially facing surface 81 having a first inclined surface 83. The slide 71 has a second incline surface 85 complementary to and engaging the first inclined surface 83. Now, when the adjustment knob 39 is depressed and rotated to adjust the bias force applied by the torsion spring, the slide is simultaneously translated to adjust the air gap 67. The wrap of the torsion spring 33 is such that when the second bevel gear 47 is rotated clockwise to increase the bias force applied by the spring 33, the air gap 67 is increased to also increase the current required to actuate the trip mechanism 31. Similarly, relaxation of the torsion spring simultaneously reduces the air gap 67 to lower the trip current. As a result, the combination of the complementary adjustment of the spring bias and the air gap increases the range of load current over which the solenoid can be selected to respond.

Figure 4:
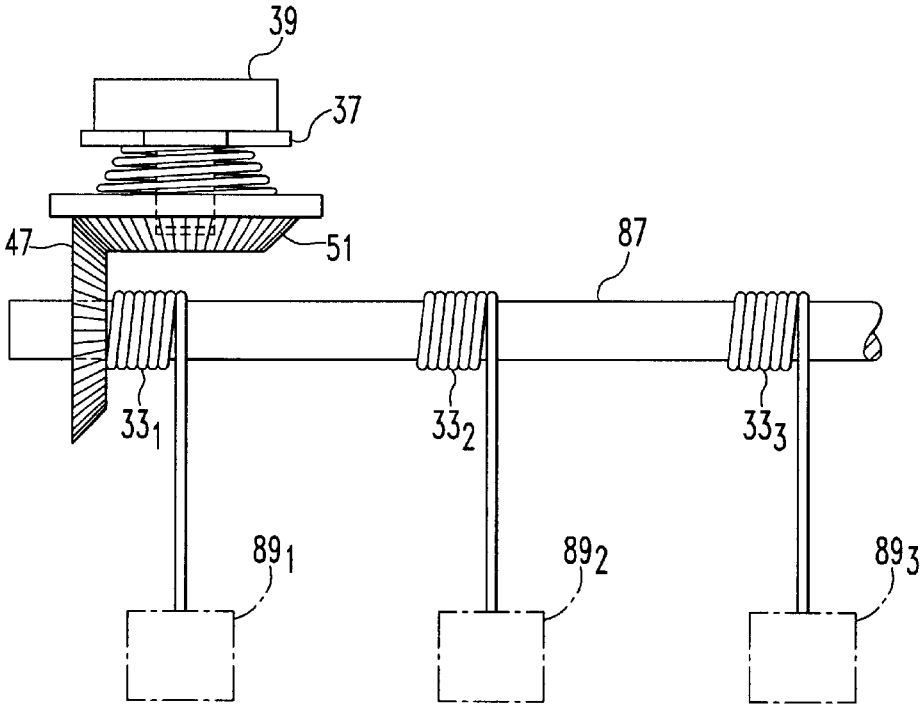
FIG. 4 is a partial elevation view of a multipole embodiment of the invention.

The invention can be applied to multipole circuit breakers as shown in FIG. 4. As shown there, the shaft 87 carrying the first bevel gear 47 is extended such that a separate torsion spring $\mathbf{33}_1$–$\mathbf{33}_3$ can be provided for each pole $\mathbf{89}_1$–$\mathbf{89}_3$ of, for instance, a three pole circuit breaker. With this arrangement, the actuating current in all of the multiple poles can be adjusted simultaneously by the rotation of the single adjustment knob 39.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An adjustable magnetic trip unit for a circuit breaker comprising:

a trip solenoid having a coil, and a plunger with a first end extendable from a first end of the coil to a trip position when the coil is energized by a current of at least a selected amplitude, and having a second end extending from the second end of the coil;

a spring assembly, including a spring engaging the second end of the plunger to apply a bias force to the plunger setting the selected amplitude of current, and an adjustment mechanism adjusting the bias force and therefore the selected amplitude of the current; and wherein the spring comprises a torsion spring having a first end engaging the second end of the plunger and a second end wound by the adjustment mechanism to adjust the bias force.

2. The adjustable magnetic trip unit of claim 1 wherein the adjustment mechanism includes an indexer setting discrete positions t o which the second end of the torsion spring is wound to provide a plurality of discrete values of the selected amplitude of current.

3. The adjustable magnetic trip unit of claim 1 wherein the adjustment mechanism includes an adjustment knob, an indexer setting a plurality of discrete positions of the adjustment knob, and a coupler coupling the adjustment knob to the second end of the torsion spring.

4. The adjustable magnetic trip unit of claim 3 wherein the coupler comprises a first bevel gear engaging the second end of the torsion spring, a second bevel gear engaging the first bevel gear, and a shaft connecting the second bevel gear to the adjustment knob for rotation by the adjustment knob.

5. The adjustable magnetic trip unit of claim 4 wherein the adjustment mechanism includes a gap adjuster engaging the second end of the plunger and driven by the first bevel gear to adjust the position to which the plunger is biased by the torsion spring.

6. The adjustable magnetic trip unit of claim 4 wherein the torsion spring has an axis coincident with a pivot axis of the first bevel gear and which is substantially perpendicular to the plunger, the shaft having an axis which is orthogonal to both the plunger and the axis of the torsion spring.

7. The adjustable magnetic trip unit of claim 6 adapted to be mounted in a circuit breaker housing having a seat wherein the indexer is mounted on the shaft and has a peripheral cam surface engagable with the seat in a plurality of discrete rotational positions.

8. The adjustable magnetic trip unit of claim 7 wherein the indexer is axially displaceable between a locked position engaging the seat and an unlocked position free of the seat in which the indexer and therefore the shaft can be rotated between the plurality of discrete positions.

9. The adjustable magnetic trip unit of claim 8 wherein the adjustment mechanism includes a second spring biasing the indexer to the locked position, the indexer being movable against the biasing provided by the second spring by depression of the adjustment knob.

10. A circuit breaker adjustable magnetic trip assembly comprising;

a housing;

a trip solenoid having a coil energized by load current and a plunger movable to a trip position in response to load current above a selected amplitude;

a torsion spring having a first end engaging the plunger to apply a bias force to the plunger setting the selected amplitude of the load current at which the plunger moves to the trip position; and an adjustment mechanism comprising:

a first bevel gear engaging a second end of the torsion spring;

a second bevel gear engaging the first bevel gear;

a shaft engaging the second bevel gear;

an adjustment knob mounted on the shaft; and an indexer setting a plurality of discrete rotational positions of the adjustment knob.

11. The circuit breaker adjustable magnetic trip assembly of claim 10 wherein the housing has a seat and the indexer selectively engages the seat at the plurality of discrete rotational positions.

12. The circuit breaker adjustable magnetic trip assembly of claim 11 wherein the indexer has a peripheral cam surface with a plurality of flats and the seat in the housing has complimentary flat surfaces.

13. The circuit breaker adjustable magnetic trip assembly of claim 12 wherein the indexer is mounted for axial movement between a locked position in which the indexer engages the seat and an unlocked position in which the indexer and adjustment knob are free to rotate, and the adjustment mechanism further includes a locking spring biasing the indexer axially to the locked position.

14. The circuit breaker adjustable magnetic trip assembly of claim 13 wherein the housing is a molded housing having a first slot forming the seat and an axially adjacent second slot with which the indexer is aligned in the unlocked position, the second slot being sized to allow rotation of the indexer.

15. The circuit breaker adjustable magnetic trip assembly of claim 14 wherein the housing has a third slot adjacent the second slot in which the second bevel gear is mounted for rotation, the adjustment knob and indexer being axially movable relative to the second bevel gear which is restrained from axial movement by the third slot.

16. The circuit breaker adjustable magnetic trip assembly of claim 10 wherein the adjustment mechanism further includes a gap adjuster adjusting an unactuated position to which the plunger is biased by the torsion spring.

17. The circuit breaker adjustable magnetic trip assembly of claim 16 wherein the gap adjuster comprises an adjustment member coupled to and moved by the first bevel gear.

18. The circuit breaker adjustable magnetic trip assembly of claim 17 wherein the plunger has a first inclined surface and the adjustment member is a slide having gear teeth coupled to the first bevel gear and a complimentary second inclined surface engaging the first inclined surface.

19. The circuit breaker adjustable magnetic trip assembly of claim 18 wherein the plunger has a first end extendable from a first end of the coil to a trip position and a second end extending from a second end of the coil and having a flange with a first axially facing surface engaged by the first end of the torsion spring and having a second axially facing surface bearing the first inclined surface.

20. The circuit breaker adjustable magnetic trip assembly of claim 10 adapted for use with a trip assembly having a plurality of poles, said assembly comprising a common shaft on which the first bevel gear is mounted and a separate torsion spring mounted on the common shaft for each of the plurality of poles.

* * * * *